US006430884B1

(12) United States Patent
Shreiner et al.

(10) Patent No.: US 6,430,884 B1
(45) Date of Patent: Aug. 13, 2002

(54) SEISMIC WALL AND CEILING EXPANSION JOINT COVERS

(75) Inventors: Thomas A. Shreiner, Picture Rocks; Roger W. Barr, Williamsport; Nathan Morris, Orangeville, all of PA (US)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

(21) Appl. No.: 09/892,410

(22) Filed: Jun. 27, 2001

(51) Int. Cl.[7] ..... E04B 1/66

(52) U.S. Cl. ..... 52/393; 52/395; 52/396.04; 52/463; 52/460; 52/470

(58) Field of Search ..... 52/395, 396.04, 52/463, 460, 470

(56) References Cited

U.S. PATENT DOCUMENTS 4,271,650 A * 6/1981 Lynn-Jones ..... 52/395
5,829,216 A * 11/1998 Newcomb et al. ..... 52/395
6,167,667 B1 * 1/2001 Balaban ..... 52/395

* cited by examiner

*Primary Examiner*—Carl D. Friedman
*Assistant Examiner*—Basil Katcheves
(74) *Attorney, Agent, or Firm*—Baker Botts L.L.P.

(57) ABSTRACT

A seismic expansion joint cover assembly installed at a motion-absorbing gap between a member A on one side of the gap and a member B on the other side of the gap includes a cover panel spanning the gap and a hinge joining one edge A of the cover panel to the member A for pivotal movement about a pivot axis. The pivot axis is spaced apart from the expansion gap so as to enable a stop between member A and the cover panel to prevent the cover panel from pivoting about the pivot axis into the expansion gap upon widening of the expansion gap. A permanent magnet and magnet striker releasably secure the other edge B of the cover panel to the member B. A tensioned cable connected between the cover panel and one of the members A and B limits the pivoting movements of the cover panel and automatically recloses the cover panel over the gap.

17 Claims, 9 Drawing Sheets

SEISMIC WALL AND CEILING EXPANSION JOINT COVERS

BACKGROUND OF THE INVENTION

Seismic expansion joint covers for buildings in geographic regions that are prone to earthquakes are of special designs that allow for movements of the building units on either side of the expansion gap that are very much greater than the movements that occur as a result of thermal expansion and contraction. In that regard, buildings currently being built in earthquake-prone regions are usually supported on isolators that attenuate the intensities of shocks imparted to the building structure but increase the durations and magnitudes of the swaying motions of the structure as the structure displaces and deforms when forces due to the earthquake are imposed on its foundation supports. When a building is composed of two or more adjacent independent structural units, each structural unit is subject to movements in an earthquake that are different in direction, frequency and magnitude. That is the case, indeed, regardless of whether the units are mounted on isolators or not.

Adjacent structural units of a building are, in particular, subject to large relative movements having components horizontally toward and away from each other (perpendicular to the gap)—x-axis movements—and components horizontally parallel to the gap—y-axis movements. Because the connections between structural units at expansion joints (which might better be termed "motion-absorbing gaps") occur at the perimeters of the structural units, the movements include small but meaningful relative displacements vertically and angularly between portions on opposite sides of gaps due to the rocking of the floors at the perimeter of the structural unit about a fulcrum in the region of the bottom center of the structural unit.

U.S. Pat. No. 5,644,879 (Shreiner et al., Jul. 8, 1997), which is owned by the assignee of the present invention and is hereby incorporated herein by reference for all purposes, describes and shows a seismic expansion joint cover assembly that is adapted to span a gap between the floors of building sections on opposite sides of a motion-absorbing gap and that permits relative movements of the floors substantially horizontally toward and away from each other along an axis perpendicular to the gap ("x-axis direction") and substantially horizontally relative to each other along an axis parallel to the gap ("y-axis direction"). The assembly includes a rectangular structural floor bridge panel that spans the gap in all relative positions of the floors. One end of the bridge panel is attached to the floor on one side of the gap ("floor A") for movement in the y-axis direction and against movement in the x-axis direction relative to floor A. The other end of the bridge panel is supported on the floor of the other building section ("floor B") for movement in the x-axis direction and against movement in the y-axis direction relative to floor B.

U.S. Pat. No. 5,666,775 (Shreiner et al., Sep. 16, 1997), which is also owned by the assignee of the present invention and is also hereby incorporated herein by reference for all purposes, describes and shows a wall expansion joint cover that is secured to the wall members on opposite sides of an expansion gap by hook and loop fasteners and is tethered to the wall by cords so that it is prevented from falling to the floor and becoming a safety hazard by impeding passage of persons across the gap during and after an earthquake dislodges it. U. S. Pat. No. 5,794,456 (Shreiner et al., Sept. 1, 1998), another patent owned by the assignee of the present invention (and hereby incorporated herein by reference for all purposes), discloses elastic cords for keeping a wall expansion joint cover centered in a motion-absorbing gap.

Both wall expansion joint covers (interior and exterior) and ceiling expansion joint covers are subject to conditions that differ somewhat from those of floor expansion joint covers. In the case of walls, the cover panel that extends across and covers the motion-absorbing gap lies vertically. Therefore, the cover panel has to be configured and installed in a manner that allows relative movements of structural units of the building perpendicular to the plane of the cover of much greater magnitudes than those of floor expansion joint covers. Exterior wall expansion joint covers are subject to high wind loads acting both toward and away from the building wall on which they are installed. Floor expansion joint covers are subject only to downward vertical loads (due to persons and objects moving across them)—gravity holds them down. The covers of wall expansion joint covers that are dislodged in whole or in part from the expansion gap do not return automatically to their installed positions after dislodgment by an earthquake. Floor expansion joint covers usually reseat automatically when an earthquake ceases. Although reseating of interior expansion joint covers is not difficult, because they are generally accessible to workers from within the building, immediate reseating of interior wall expansion joint covers to close the relatively large motion-absorbing gap is important to the safety of persons that occupy the building after an earthquake. Reseating of exterior wall expansion joint covers above the ground floor, though not required immediately except possibly in bad weather to prevent intrusion of rain or snow, requires workers to climb ladders or be lowered on cable-supported work platforms to gain access to the wall covers.

Ceiling expansion joint covers are subject to the same relative motions as floor expansion joint covers. Whereas floor expansion joint covers are essentially self-seating by gravity, ceiling expansion joint covers must be fastened against gravity. Like wall expansion joint covers, ceiling expansion joint covers can be reseated from within the building. It is desirable, however, for convenience and safety that they not be permitted to move appreciably away from the plane of the ceiling when they are dislodged in an earthquake.

Although the expansion joint covers disclosed in the aforementioned patents and various other previously known expansion joint covers meet the requirements imposed on them reasonably well, there is a need for wall and ceiling expansion joint covers that are relatively simple in construction and function, relatively inexpensive to produce and install, capable of reseating automatically after the end of an earthquake that dislodges them, and versatile as far as utility in various environments is concerned. Further desirable objectives that are not fully met by many previously known wall and ceiling expansion joint covers include light weight cover panels, which minimizes dynamic loads exerted on various parts of the expansion joint cover system, and reliable, long-lived functional elements, which resist damage and enable a long service life of an installation without repair or replacement.

SUMMARY OF THE INVENTION

The foregoing needs and objectives are met, in accordance with the present invention, by a seismic expansion joint cover assembly installed at a motion-absorbing gap between a member A on one side of the gap and a member B on the other side of the gap. The assembly includes a cover panel spanning the gap and a hinge joining one edge A of the cover panel to the member A for pivotal movement about a pivot axis. The pivot axis is spaced apart from the expansion gap so as to enable a stop between the cover panel and member A to prevent the cover panel from pivoting about the pivot axis into the expansion gap upon widening of the expansion gap. A permanent magnet and magnet striker releasably secure the other edge B of the cover panel to the member B.

The hinged connection of the end A of the cover panel to the member A leaves the end B free to swing out a considerable distance when member B moves relative to member A such as to engage the cover panel and to release the magnetic connection. That aspect of the invention is especially useful for interior and exterior wall covers, in which the cover panels are vertical and the members A and B displace relative to one another horizontally in directions parallel to the center plane of the expansion gap. The location of the pivot axis in spaced-apart relation from the gap and a stop on member A prevents the cover panel from moving into the gap when the gap widens. The magnetic latching of the cover panel to the member B holds the cover panel closed under normal (no earthquake) conditions, is relatively inexpensive and reliable, and allows the member B to move relative to member A by sliding of the magnet relative to the striker upon small movements of members A and B due to thermal expansion/contraction of the building units of which members A and B are parts.

In order to best use available space and keep the cover panel light in weight, it is preferable that the magnet be mounted on the member B and the magnet striker be mounted on the cover panel.

Preferred embodiments of the present invention incorporate a biasing system connected to the cover panel at a location spaced apart from the pivot axis and connected to one of the members A and B for continuously biasing the cover panel about the pivot axis toward a covering relation to the expansion gap with the permanent magnet and magnet striker engaged. A biasing system restricts the extent of the of pivotal movement of the cover panel away from the closed position in an earthquake and recloses the cover panel after an earthquake. Reclosing of the cover panel on an interior wall and a ceiling is highly desirable for the safety of persons who pass across the motion-absorbing gap. Automatic reclosing of the cover panel on an exterior wall by a biasing system makes it unnecessary for workers to manually reclose the cover panel and provides immediate reclosing for weather protection.

One suitable biasing unit includes a weight and a flexible strand, such as a rope or wire cable. The strand is connected at one end to the cover panel, is trained over a guide secured to one of the members A and B, runs from the guide to the weight, and is joined at the other end to the weight. The weight is freely supported vertically by a segment of the strand running from the guide to the weight. Although a biasing unit based on a suspended weight can be used in installations on interior walls and ceilings, it has the particular advantage in an exterior wall cover installation of readily providing a strong and constant closing force, which not only ensures closing of the cover panel against wind loads but provides a force supplementing the magnet latch to hold the cover panel closed against wind loads that can create a pressure difference between the inside and outside of the cover panel when the cover panel is on the downwind side of the building. It is desirable for the weight to be slidably received in a guide tube that prevents the weight from swinging in an earthquake while permitting the weight to move vertically. The guide tube may be mounted on member B in a recess adjacent the corner of the gap. The magnet can also be mounted in the recess.

Uncontrolled rebounding or "hopping" of the weight can produce high loads on all elements of a biasing system having a weight. In preferred embodiments of weight-based biasing arrangements according to the present invention, an anti-rebound shock cord is connected between the weight and a fixed point substantially vertically below the weight (at the lowest point of the weight). The anti-rebound shock cord arrests upward movements of the weight at all positions of the weight. For example, when the cover panel stops moving from closed to open, the anti-rebound shock cord retards the continued upward movement of the weight due to its inertia and supplements the gravity force on the weight in moving the weight down. The force of the anti-rebound shock cord is also an element of the total closing force applied to the cover panel.

Another suitable biasing unit includes an elastic member, such as a length of "shock cord," connected under tension between the cover panel and one of the members A and B. An elastic member is relatively inexpensive and easy to install. An elastic member can be connected at its ends to the cover panel at spaced-apart locations axially of and within the gap and hooked for free running intermediate the ends to one of the members A and B. The free-running of the intermediate connection through a hook provides substantially equal tension forces between the hook and the ends.

In preferred embodiments, the cover panel includes a skeletal frame, aluminum members being desirable for low weight, and a facing member secured to the frame. The facing member may, for example, be a sheet of a metal or a composite material.

For good appearance of the cover installation, member A and member B may have recesses adjacent the gap that receive edge portions of the cover panel so that the exterior surfaces of the cover panel are flush with surfaces of the members A and B adjacent the recesses. In a recessed installation, a frame member is provided at the edge of the recess of member B remote from the expansion gap, the frame member having a cam surface sloping away from the gap in a direction from the base of the recess toward the surface of member B adjacent the recess. The cover panel has an panel edge nose having a sloping cam follower surface complementary to the cam surface of the frame member. The cam and cam follower surfaces interact upon narrowing of the motion-absorbing gap to apply a force to the cover panel to release the magnet from the magnet striker. The cam surface and cam follower surface are normally spaced apart to enable movements of the cover panel relative to member B upon thermal expansion/contraction of building units of which members A and B are parts.

For a better understanding of the invention, reference may be made to the following description of exemplary embodiments, taken in conjunction with the accompanying drawings.

DESCRIPTION OF THE EMBODIMENTS

Figure 1:
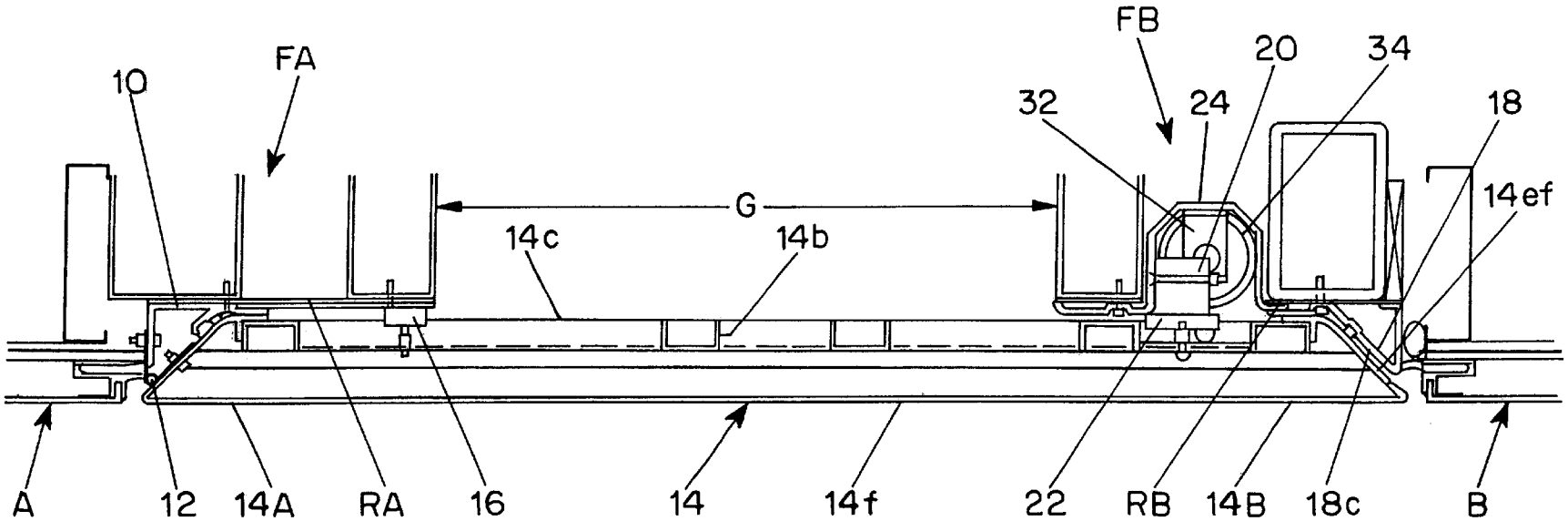
FIG. 1 is a top plan view of an embodiment of an exterior wall cover.
Figure 2:
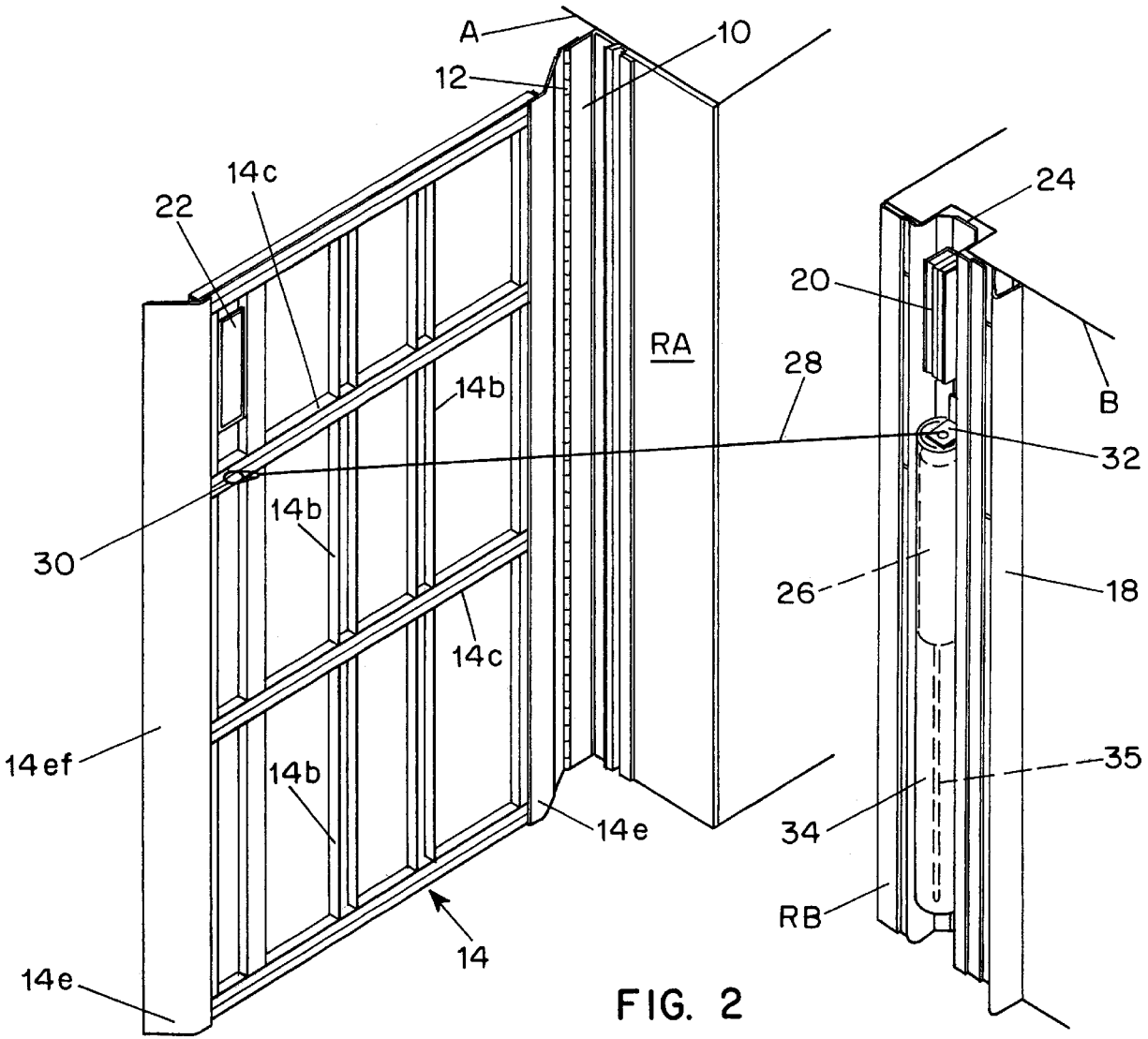
FIG. 2 is a simplified perspective view of the embodiment of FIG. 1, showing the cover panel swung open—to permit a clearer showing of the embodiment, the cover panel is shown in a position far more widely open that it would be in an earthquake.

The exterior wall installation shown in FIGS. 1 and 2 includes suitable framing FA and FB at the corners of the building units on opposite sides of a motion-absorbing gap G. The framing F is designed to provide recesses RA and RB set in from the surfaces of the wall A and the wall B. An elongated vertical retainer 10 is fastened along the edge of the recess RA remote from the gap G. A hinge 12 fastened to the retainer 10 and to one edge 14A of a cover panel 14 pivotally supports the cover panel for pivoting movement about a vertical axis that is parallel to the center plane of the gap G and spaced apart from the corner of the wall A at the gap. The spacing from the corner is needed to enable a stop between the cover panel and the recess RA, which desirably includes a cushion or bumper 16, to be provided at a location on the wall A between the corner of the gap G and the pivot axis of the cover panel that prevents the cover panel from swinging into the gap when the gap widens in an earthquake. An elongated vertical frame member 18 of the installation is fastened along the edge of the recess RB. The panel has a light-weight skeletal framework built up from extruded aluminum vertical edge members 14*e,* horizontal cross members 14*c* and vertical brace members 14*b* (FIG. 2). The frame members are suitable joined at the joints, such as by welding. A facing sheet 14*f* of aluminum is welded to the framework. The cover panel can be constructed in other ways of other suitable materials, such as composites of fiber materials and resin binders.

The cover panel 14 is normally (no earthquake) held in a closed position covering the gap G by a strong permanent magnet 20 that is affixed to the wall B and a magnet striker 22 that is affixed to the cover panel 14. The magnet is received in the upper end portion of a vertical cavity formed by a channel member 24 fastened to the wall B. The latching force of the magnet is supplemented by a weight 26 that is tethered to the cover panel by a flexible wire cable or synthetic rope 28. The cable or rope 28 leads from a fastening point 30 at one end to the cover panel, through a guide 32, and thence to the weight 26. The weight is received within a guide tube 34 that is installed in the channel and prevents the weight from swinging in an earthquake while allowing it to move freely vertically up and down. The holding force (magnetic latch and weight) hold the cover panel in the closed position covering the gap G against outward pressure on the cover panel due to wind loads when the cover panel is on the downstream side of the building units relative to the wind. Several hundred pounds total force is needed.

As mentioned above, uncontrolled rebounding or "hopping" of the weight 26 can produce high loads on all elements (i.e. the cable or rope 28, connectors 30, and guides 32) of a biasing system having a weight. An anti-rebound shock cord 35 is connected between the weight 26 and a fixed point substantially vertically below the weight (at the lowest point of the weight). In the embodiment, the shock cord 35 is located within the guide tube 34 and is fastened to the lower end of the guide tube. The anti-rebound shock cord 35 arrests upward movements of the weight at all positions of the weight. For example, when the cover panel 14 stops moving from closed to open, the anti-rebound shock cord 35 retards the continued upward movement of the weight 26 due to its inertia and supplements the gravity force on the weight 26 in moving the weight down. The force of the anti-rebound shock cord 35 is also an element of the total closing force applied to the cover panel 14.

Although the behavior of the cover installation in an earthquake is described in some detail below, one may note at this point that the frame member 18 at the edge of the recess RB in the wall B has a cam surface 18*c* that slopes away from the gap G and the base of the recess RB toward the surface of the wall B adjacent the recess RB. The edge frame 14*e* of the framework of the cover panel 14 has a cam follower surface 14*ef* that is complementary to the cam surface 18*c* of the frame member 18. When the gap G narrows in an earthquake, the cam surface 18*c* works against the cam follower surface 14*ef* to push the cover panel out of the recess RB, thereby releasing the magnet latch. After the edge portion 14B of the cover panel 14 is completely out of the recess, the inner surface of the cover panel rides along the corner of the wall B at the gap G upon further narrowing of the gap.

Figure 3:
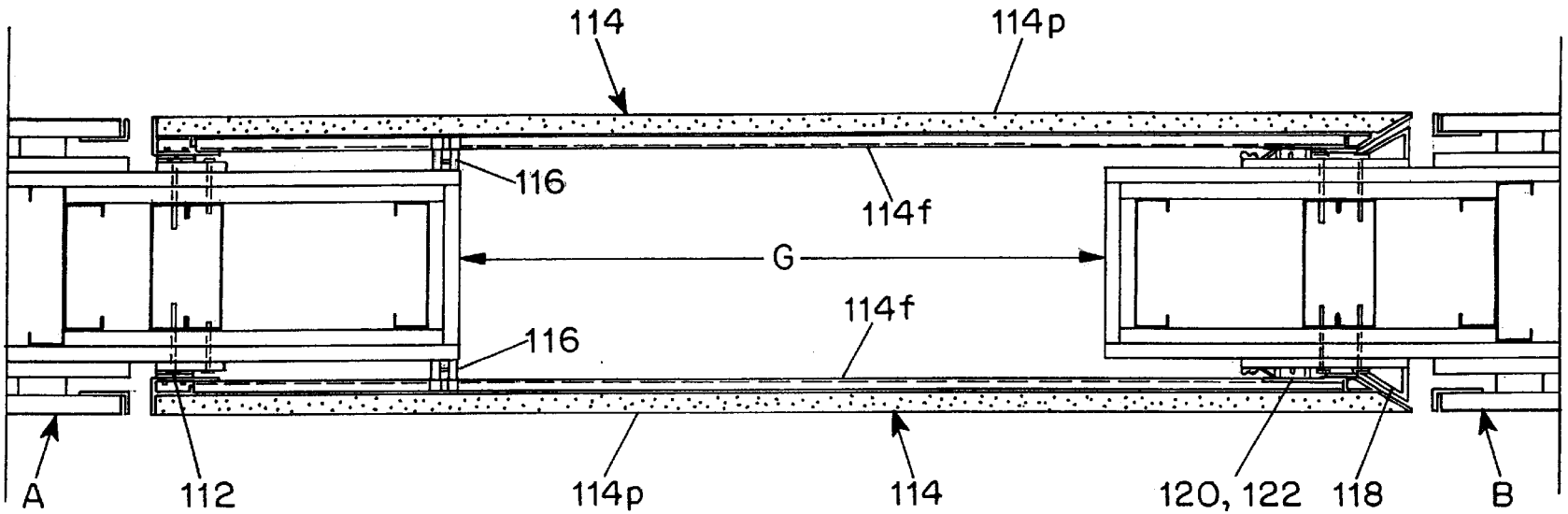
FIG. 3 is a top plan view of an embodiment of an interior wall cover.
Figure 4:
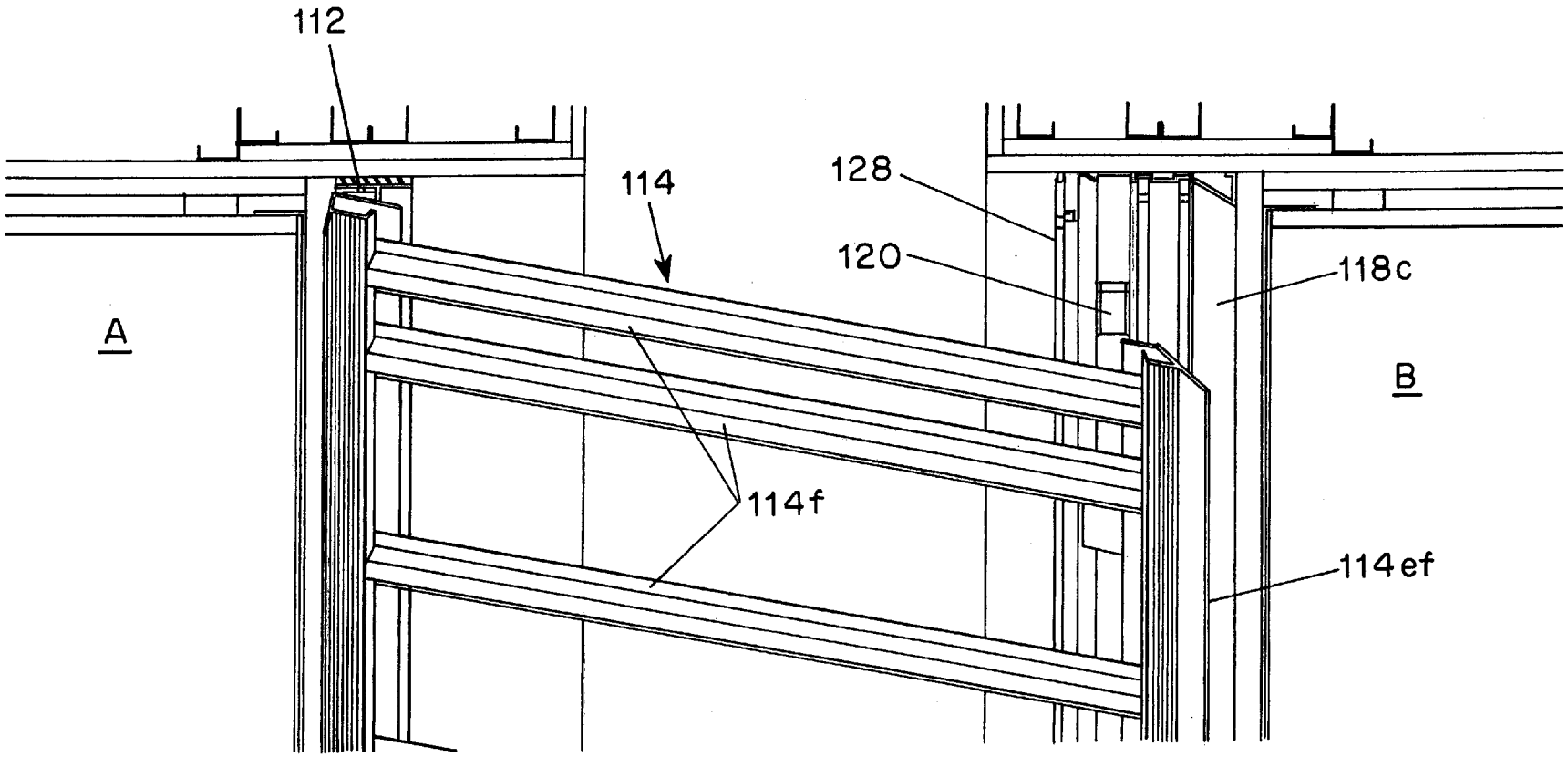
FIG. 4 is a simplified perspective view of the embodiment of FIG. 2.

The embodiment of an interior wall assembly shown in FIGS. 3 and 4 is similar in most respects to the exterior wall assembly of FIGS. 1 and 2. Therefore, the reference numerals of FIGS. 1 and 2, increased by 100, are applied to the corresponding parts of FIGS. 3 and 4. Duplicate cover installations are provided on opposite sides of partition walls A and B of the building units on opposite sides of the expansion gap G. Only the main differences between the installation of FIGS. 1 and 2 and FIGS. 3 and 4 are described, to wit: The cover panel 114 has a lightweight aluminum ladder framework 114*f* that receives a suitable durable finish panel 114*p,* such as an aluminum sheet, a composite sheet, a sandwich panel having a honeycomb or a polymeric foam core and skins, or drywall. (The facing panel 114*p* is omitted in FIG. 4). An elastic "shock cord" 128 is connected under tension between the end portion 114 B of the cover panel 114 and the wall B. The manner of attachment of the shock cord 128 may be similar to that shown in FIGS. 5 and 6 and described below.

Figure 5:
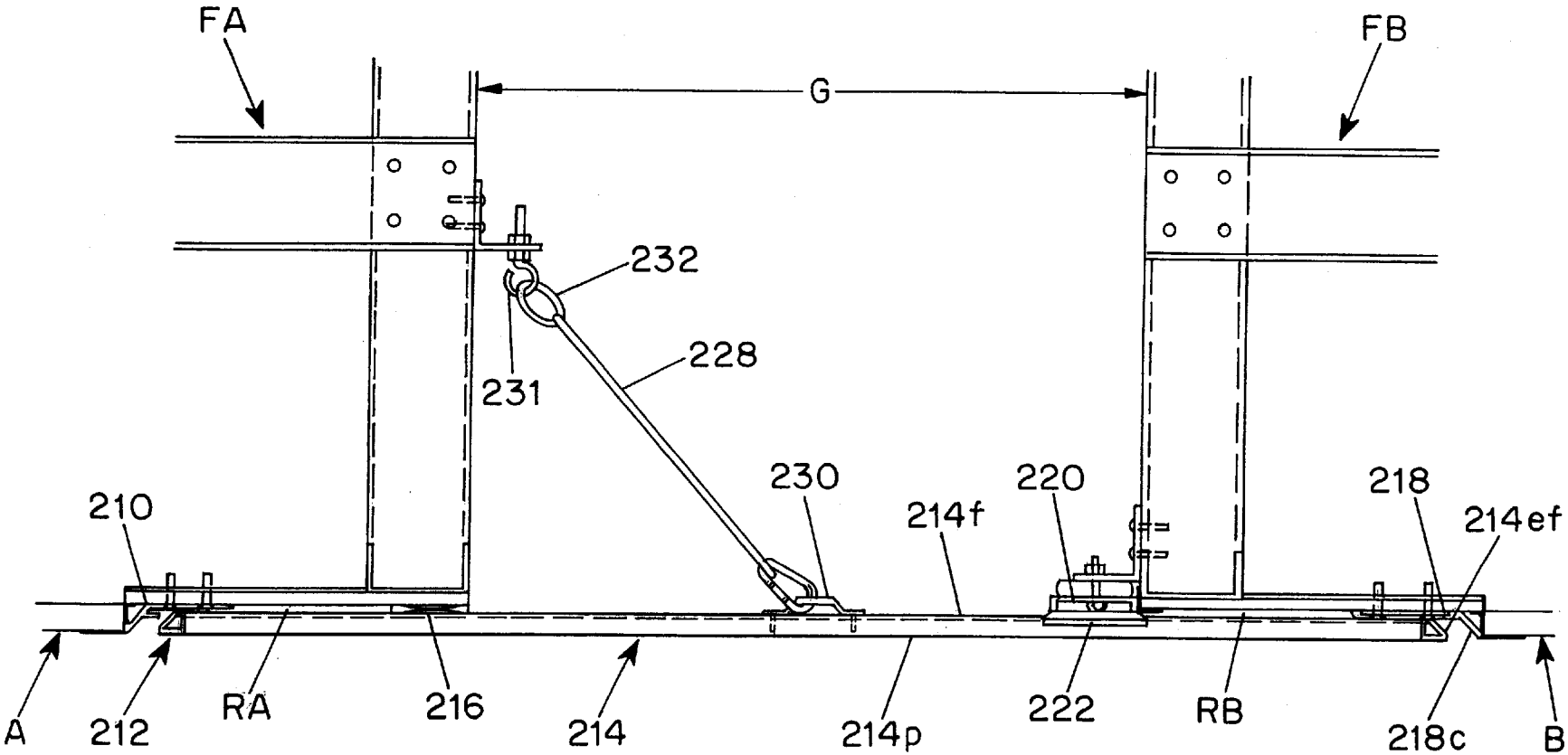
FIG. 5 is an end elevational view of an embodiment of a ceiling cover.
Figure 6:
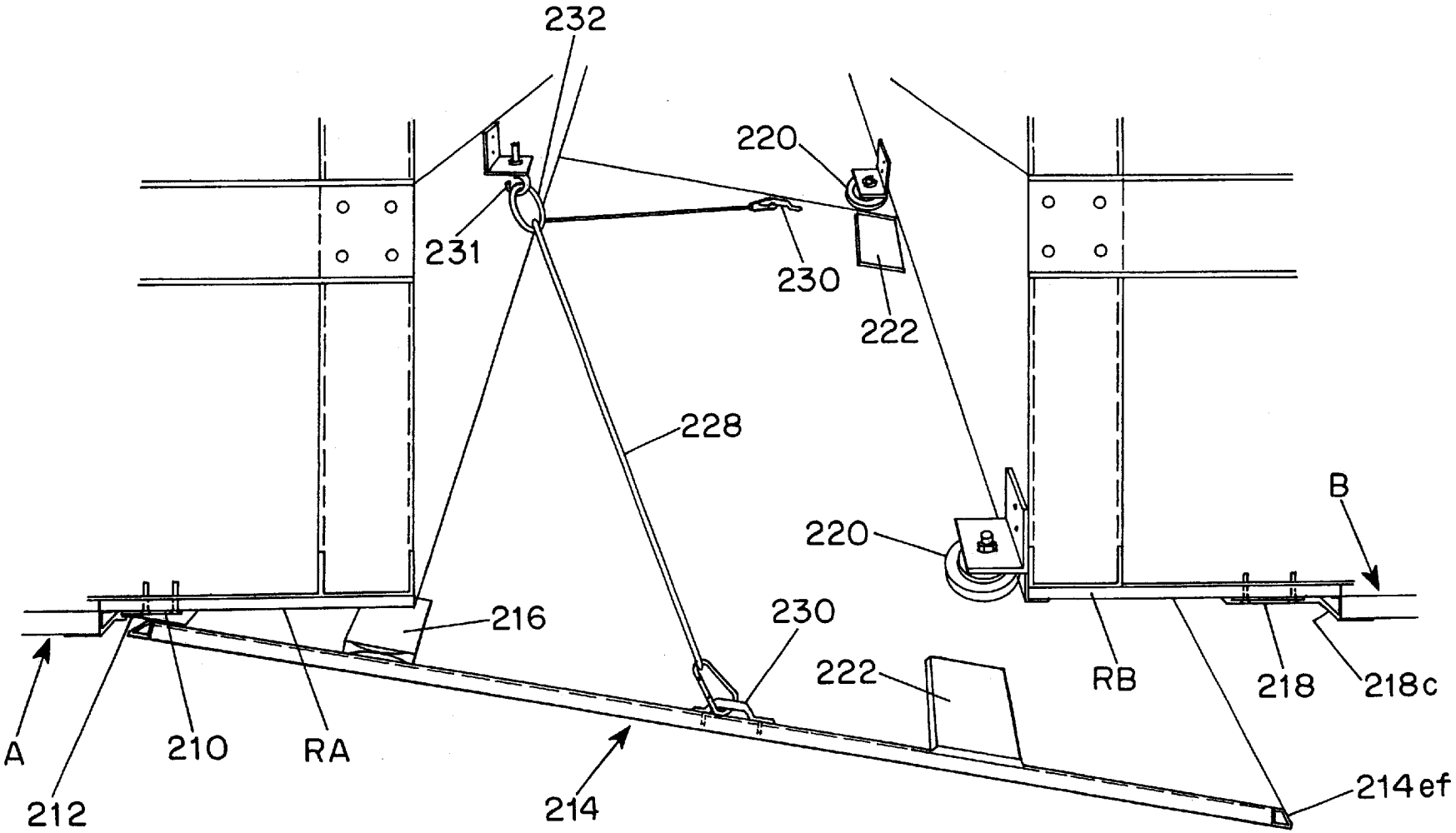
FIG. 6 is a simplified perspective view of the embodiment of FIG. 5, showing the cover panel swung open.

The embodiment of a ceiling cover assembly shown in FIGS. 5 and 6 is similar in most respects to the assemblies FIGS. 1 to 4. Therefore, the reference numerals of FIGS. 1 and 2, increased by 200, are applied to the corresponding parts of FIGS. 5 and 6. Only the main differences between the installation of FIGS. 1 and 2 and FIGS. 5 and 6 are described.

Figure 7:
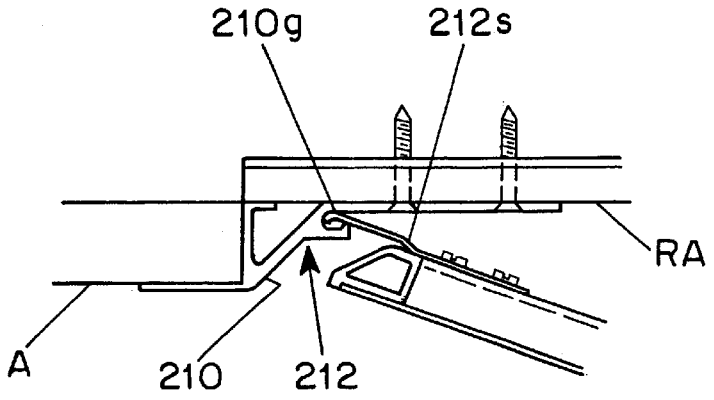
FIG. 7 is a detail end view of the hinge of the embodiment of FIG. 6.

The cover panel 214 has a lightweight framework of extruded aluminum members 214*f* and a facing panel 214*p* of aluminum sheet. An elastic "shock cord" 228 is installed under tension between spaced-apart connectors 230 on the cover panel 214 and a hook 231 and a ring 232 affixed to the member A above the cover panel and midway between the connectors 230. The cord 228 is free to slide through the ring 232 when the members A and B move parallel to the gap G. Normally (no earthquake), the cord 228 applies equal forces on the cover panel 214 to assist the magnets 220 in holding the cover panel flush with the ceiling. The magnet strike plates 222 are mounted on the cover panel with their exposed surfaces flush with adjacent surfaces of the cover plate 214, so that when the member A moves horizontally relative to the member B in an earthquake in a direction parallel to the gap G (perpendicular to the drawing sheets of FIGS. 5 and 6), the cover panel 214 can slide relative to the magnets 220 without catching of the magnets on exposed edges of the magnets. As shown in the detail view of FIG. 7, the hinge 212 is formed by an undercut groove 210*g* in the retainer 210 and a strip 212*s* having a hooked end that is received in the groove. The hook and groove hinge simplifies installation of the cover panel.

FIGS. 8 to 14 show the possible states of relative movements of the members A and B that occur in an earthquake and the positions assumed by the cover panels of exterior (FIGS. 1 and 2) and interior (FIGS. 3 and 4) expansion joint installations. The positions assumed by a ceiling installation (FIG. 5 and 6) are a little different but can be generally understood from FIGS. 8 to 14, considered with a brief description given below. For simplicity in describing the movements, please consider that on the drawing sheets of FIGS. 8 to 14 that north is at the top of the sheet, east is to the right and west is to the left. Horizontal movements occur in the plane of the drawing sheets.

Figure 8:
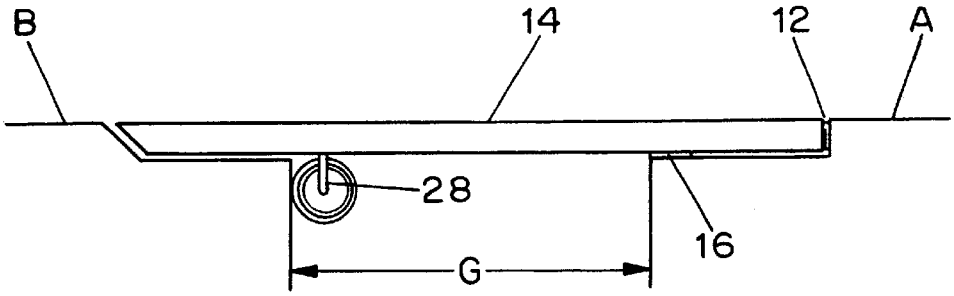
FIGS. 8 to 14 are diagrams showing the movements of a cover panel that result from movements of the building units on opposite sides of the motion-absorbing gap that occur in an earthquake.
Figure 9:
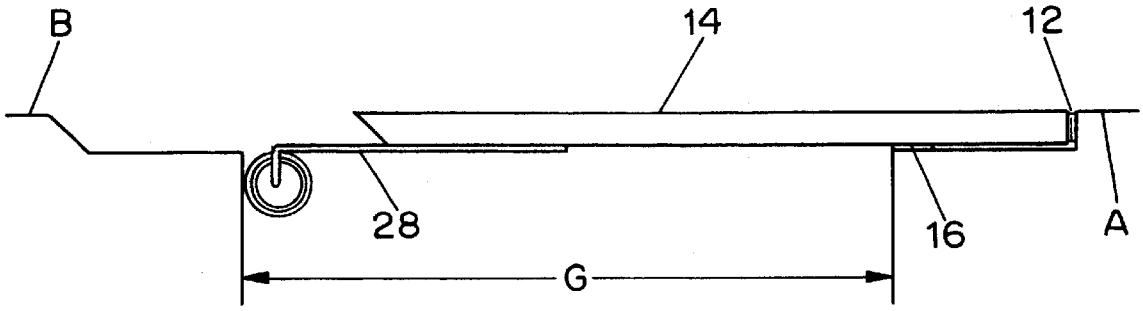
Figure 10:
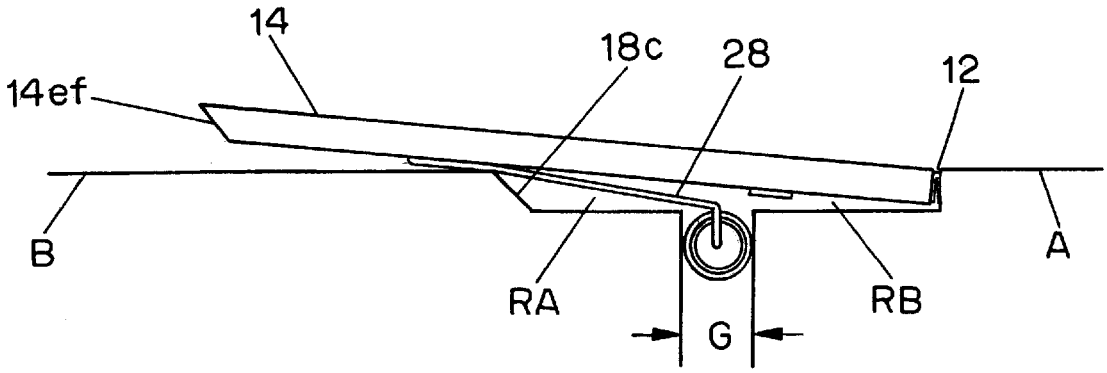
Figure 11:
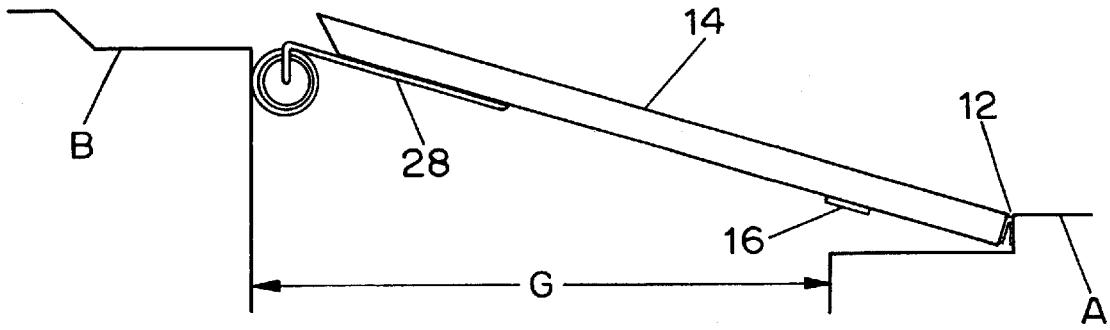
Figure 12:
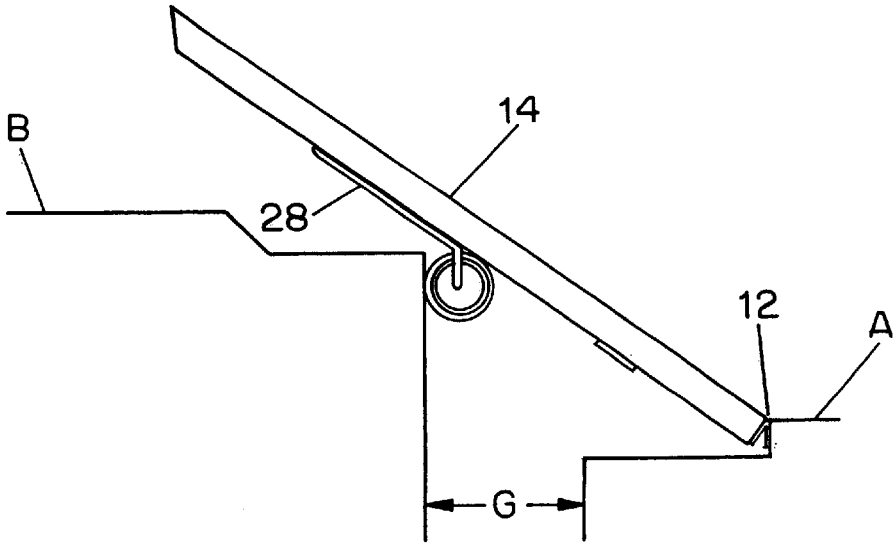
Figure 13:
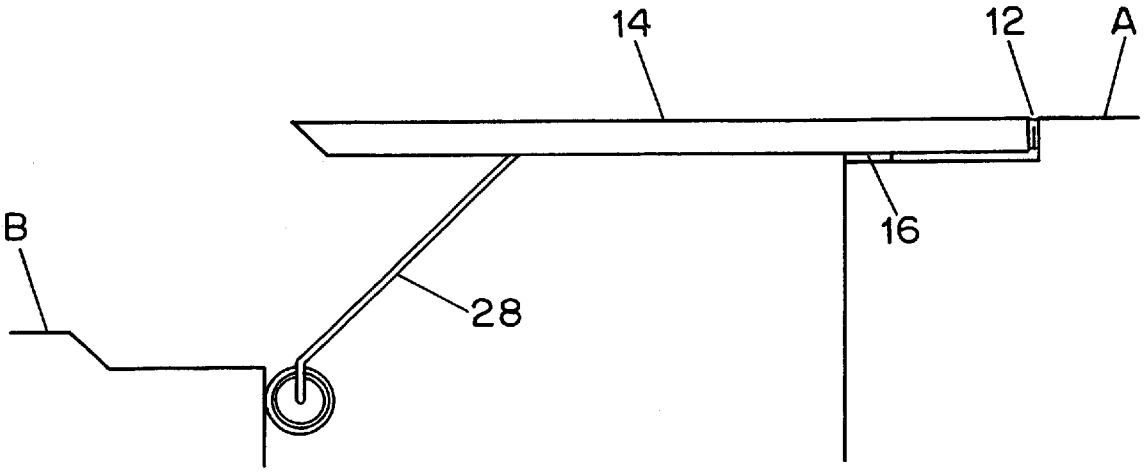
Figure 14:
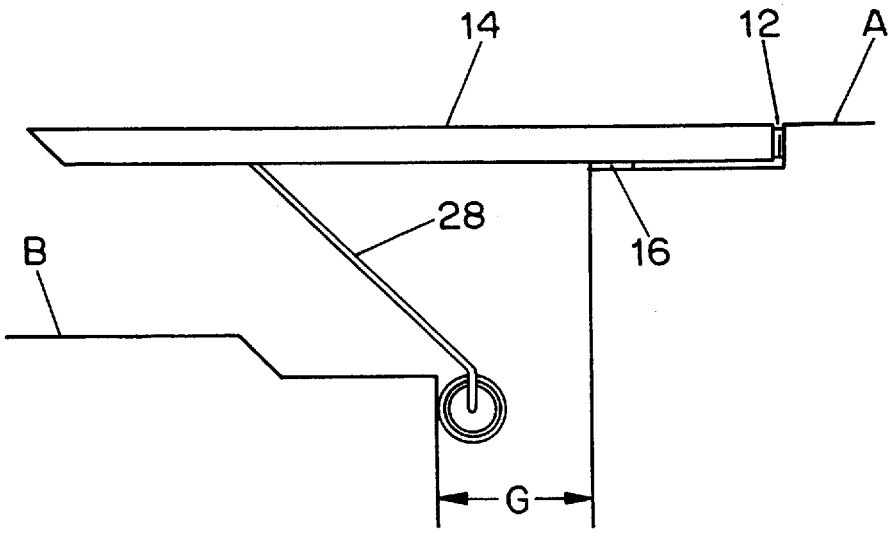

FIG. 8 shows the cover panel 14 held closed by the combined forces of the magnet/striker 20/22 (not shown in FIGS. 8 to 14) and the tensioned cable 28. In an earthquake, the following motions—which are described cryptically for brevity—occur:

FIG. 9—member B moves west relative to member A but does not move north or south—hence gap G widens—stop 16 keeps cover panel 14 from pivoting south into gap G;

FIG. 10—B moves east relative to A but does not move north or south—gap narrows—camming action at 18*c*/14*ef* pushes panel out of recess RA—inner face of panel slides on edge of retainer 18;

FIG. 11—gap widens and B moves north relative to A—panel pivots out due to tension force of cable;

FIG. 12—gap narrows and B moves north relative to A—panel pivots out and inner face of panel rides on corner of B at the gap;

FIG. 13—gap widens and B moves south relative to A—stop keeps panel from pivoting south into gap at urging of tensioned cable;

FIG. 14—gap narrows and B moves south relative to A—stop keeps panel from pivoting south into gap at urging of cable.

Tilting motions of the walls from the vertical are accommodated by rocking of the free edge of the cover panel (edge remote from hinge) about the upper or lower edge of the panel relative to member B when the gap narrows and member B moves north relative to member A.

In an earthquake, a ceiling installation (FIGS. 5 and 6) is subject to large horizontal movements parallel and perpendicular to the center plane of the gap G and to small tilting movements of B relative to A. When the gap narrows, the camming action at 218*c*/214*ef* pushes the cover panel 214 out so that its upper surface rides on the lower edge of the frame member 218. The force of the tensioned cable 228 keeps the cover panel from pivoting down. When the gap widens, the stop 216 keeps the cover panel from pivoting up into the gap. When B moves north or south relative to A, the free end of the cover panel slides relatively freely along the frame member 218 when the gap narrows.

As mentioned above, automatic reclosing of the cover panel and reengagement of the magnet/striker after the earthquake ends by the tension force of the cable is a highly desirable, but not essential, feature. The tensioned cables also arrest swinging movements of the cover panels of wall installations away from the gap and keep the cover panels of ceiling installations from pivoting downwardly, thus making interior wall installations and ceiling installations safer for persons who move between the structural units during an earthquake.

What is claimed is:

1. A seismic expansion joint cover assembly installed at a motion-absorbing gap between a member A on one side of the gap and a member B on the other side of the gap, comprising a cover panel spanning the gap, a hinge joining one edge A of the cover panel to the member A for pivotal movement about a pivot axis, the pivot axis being spaced apart from the expansion gap so as to enable a stop on member A to prevent the cover panel from pivoting about the pivot axis into the expansion gap upon widening of the expansion gap, and a permanent magnet and magnet striker releasably securing the other edge B of the cover panel to the member B.

2. The seismic expansion joint cover assembly according to claim 1, wherein the magnet is mounted on the member B and the magnet striker is mounted on the cover panel.

3. The seismic expansion joint cover assembly according to claim 1, and further comprising a biasing unit connected to the cover panel at a location spaced apart from the pivot axis and connected to one of the members A and B for continuously biasing the cover panel about the pivot axis toward a covering relation to the expansion gap with the permanent magnet and magnet striker engaged.

4. The seismic expansion joint cover assembly according to claim 3, wherein the biasing unit includes a weight and a flexible strand connected at one end to the cover panel, trained over a guide secured to one of the members A and B, running from the guide to the weight, and joined at the other end to the weight, the weight being freely supported vertically by a segment of the strand running from the guide to the weight.

5. The seismic expansion joint cover assembly according to claim 4, wherein the weight is slidably received in a guide tube that prevents the weight from swinging in an earthquake while permitting the weight to move vertically.

6. The seismic expansion joint cover assembly according to claim 5, wherein the guide tube is mounted on member B in a recess adjacent the corner of the gap.

7. The seismic expansion joint cover assembly according to claim 4, and further comprising an anti-rebound shock cord connected between the weight and a fixed point substantially vertically below the weight at the lowest point of the weight) for arresting upward movements of the weight at all positions of the weight.

8. The seismic expansion joint cover assembly according to claim 2, wherein the members A and B are exterior walls, the biasing unit includes a weight and a flexible strand connected at one end to the cover panel, trained over a guide secured to one of the members A and B, running from the guide to the weight, and joined at the other end to the weight, the weight being freely supported vertically by a segment of the strand running from the guide to the weight.

9. The seismic expansion joint cover assembly according to claim 8, wherein the weight is slidably received in a guide tube that prevents the weight from swinging in an earthquake while permitting the weight to move vertically.

10. The seismic expansion joint cover assembly according to claim 8, wherein the guide tube and the magnet are mounted on member B in a recess adjacent the corner of the gap.

11. The seismic expansion joint cover assembly according to claim 3, wherein the biasing unit includes an elastic member connected under tension between the cover panel and one of the members A and B.

12. The seismic expansion joint cover assembly according to claim 11, wherein the ends of the elastic member are connected to the cover panel at spaced-apart locations axially of and within the gap and the elastic member is hooked for free running intermediate the ends to one of the members A and B.

13. The seismic expansion joint cover assembly according to claim 1, wherein the cover panel includes a skeletal frame and a facing member secured to the frame.

14. The seismic expansion joint cover assembly according to claim 1, wherein member A and member B have recesses adjacent the gap that receive edge portions of the cover panel, and wherein surfaces of the edge portions of the cover panel are flush with surfaces of the members A and B adjacent the recesses.

15. The seismic expansion joint cover assembly according to claim 14, and further comprising a frame member secured to the edge of the recess of member B remote from the expansion gap, the frame member having a cam surface sloping away from the gap in a direction from the base of the recess toward the surface of member B adjacent the recess, and the cover panel having an panel edge nose having a sloping cam follower surface complementary to the cam surface of the frame member, the cam and cam follower surfaces interacting upon closing of the gap to apply a force to the cover panel to release the magnet from the magnet striker.

16. The seismic expansion joint cover assembly according to claim 15, wherein cam surface and cam follower surface are normally spaced apart to enable movements of the cover panel relative to member B upon thermal expansion/contraction of building units of which members A and B are parts.

17. The seismic expansion joint cover assembly according to claim 1, and further comprising a bumper associated with the stop of member A.

* * * * *

UNITED STATES PATENT AND TRADEMARK OFFICE

CERTIFICATE OF CORRECTION

PATENT NO. : 6,430,884 B1
DATED : August 13, 2002
INVENTOR(S) : Shreiner et al.

It is certified that error appears in the above-identified patent and that said Letters Patent is hereby corrected as shown below:

Column 4,
Line 42, “an” should read -- a --
Line 64, “that” should read -- than --

Column 5,
Line 37, “suitable” should read -- suitably --

Column 8,
Line 50, “weight)” should read -- weight --

Signed and Sealed this

Fourth Day of February, 2003

JAMES E. ROGAN
*Director of the United States Patent and Trademark Office*